United States Patent [19]

Carter et al.

[11] Patent Number: 4,688,643

[45] Date of Patent: Aug. 25, 1987

[54] FIREFIGHTING BACK TANK AND PUMP

[75] Inventors: Stanley D. Carter, Delta; Blayney Scott, Victoria, both of Canada

[73] Assignee: Fireflex Manufacturing, Ltd., Canada

[21] Appl. No.: 851,131

[22] Filed: Apr. 11, 1986

[30] Foreign Application Priority Data

Feb. 8, 1985 [CA] Canada ..... 473945

[51] Int. Cl.[4] ..... A62C 11/02; A62C 15/00

[52] U.S. Cl. ..... 169/33; 169/52; 222/175; 224/148; 239/153

[58] Field of Search ..... 169/30, 33, 52; 239/153, 154, 152; 222/175; 224/148

[56] References Cited

U.S. PATENT DOCUMENTS

| | | | |
|---|---|---|---|
| 636,375 | 11/1899 | Beariks | 222/175 |
| 1,279,992 | 9/1918 | Creamer | 169/33 X |
| 1,753,073 | 4/1930 | Troften | 224/148 |
| 1,875,992 | 9/1932 | Clifford | 239/153 X |
| 1,902,548 | 3/1933 | Fenwick, Jr. | 239/153 X |
| 1,913,006 | 6/1933 | Smith | 239/153 X |
| 2,192,256 | 3/1940 | Brandt | 239/153 X |
| 2,606,701 | 8/1952 | Huthsing | 224/148 |
| 3,095,123 | 6/1963 | Smith, Sr. et al. | 222/175 |

FOREIGN PATENT DOCUMENTS

| | | | |
|---|---|---|---|
| 1197163 | 11/1959 | France | 239/153 |
| 71634 | 2/1916 | Switzerland | 224/148 |

*Primary Examiner*—Jeffrey V. Nase

*Attorney, Agent, or Firm*—Klarquist, Sparkman, Campbell, Leigh & Whinston

[57] ABSTRACT

A novel portable flexible water tank and pump which can be carried on a firefighter's back and used for fighting forest fires. The water carrying backpack and water pump combination comprises: (a) a flexible hollow waterproof water container; (b) harness means attached to the water container suitable for securing the water container to the back of a human being; (c) means attached to the water container for filling the water container; (d) hand operated water pumping means; (e) means for connecting the hand operated water pumping means with the water container in order to permit water from the interior of the water container to be delivered to the hand operated water pump; and (f) perspiration ventilation means located on the side of the water container which rests against the back of the human being.

8 Claims, 4 Drawing Figures

FIREFIGHTING BACK TANK AND PUMP

FIELD OF THE INVENTION

This invention is directed to a novel portable flexible water tank and pump which can be carried on a firefighter's back and used for fighting forest fires. More particularly, this invention is directed to a novel portable flexible water tank and pump which includes perspiration vents and a kidney insulating pad to prevent firefighter fatigue in firefighting conditions.

BACKGROUND OF THE INVENTION

For years, it has been customary practice in fighting fires for firefighters to carry water back packs and water hand pumps and use them at the fire site. The back pack is filled with water from any readily available source such as a creek, melting snow, puddles, or the like, and the water is carried on the back of the firefighter to the fire site. At the site, the firefighter directs a stream of water at the fire by operating a hand pump which is attached to the back pack.

Studies conducted under firefighting conditions in North America and Australia have indicated that firefighters when engaged in fighting a fire suffer from premature fatigue and very high heartbeat rates. Electrocardiograms taken of firefighters operating under these conditions have demonstrated that their heartbeats are so high that they experience premature fatigue. An aggravating factor is that substantial body heat is lost from the kidneys and lower back area into the cold water carried in the backpack.

Another difficulty with conventional waterproof water backpacks and hand pumps is that they do not permit perspiration to escape from the back of the firefighter. It has been learned that inhibiting evaporation of perspiration from the back of the firefighter leads directly to premature fatigue. Thus, the firefighter tires prematurely and cannot continue to fight the fire. This is a serious problem with most forest fire situations because usually there is a shortage of men available to fight the forest fire and premature fatigue reduces further the number of men available.

A third problem, which is mechanical in nature, is that in many cases the water that is used to fill the backpack is not clean but is full of dirt, debris and the like. This material accumulates in the backpack and often blocks the water inlet into the waterpump. In such cases, the water pump must be dismantled and the blocked inlet cleaned of debris before the unit can be used again. This causes down-time of equipment at the fire site.

The applicant is aware of U.S. Pat. No. 1,902,548, F. F. Fenwick, Jr., Mar. 21, 1933, which discloses a flexible collapsible water backpack and hand pump for use in fighting forest fires and the like. The backpack is constructed so that it can be carried on the back in a folded condition to form a compartment for holding water. The backpack is carried on the back by means of a shoulder strap and girth harness.

U.S. Pat. No. 1,953,331, granted Apr. 3, 1934, J. Armstrong, disclose a water backpack design which can be carried on the back of a pack animal. A series of the packs can be carried on the backs of a proportionate number of pack animals and connected together in series.

SUMMARY OF THE INVENTION

The invention is directed to a novel water carrying backpack and water pump combination which is useful in fighting fires. The combination comprises: (a) a flexible hollow waterproof water container; (b) harness means attached to the water container suitable for securing the water container to the back of a human being; (c) means attached to the water container for filling the water container; (d) hand operated water pumping means; (e) means for connecting the hand operated water pumping means with the water container in order to permit water from the interior of the water container to be delivered to the hand operated water pump; and (f) perspiration ventilation means located on the side of the water container which rests against the back of the human being.

The water container may be constructed generally to have the shape of an inverted "T". The ventilation means may consist of at least one crease which is formed on the back-facing side of the water container. The water container may include heat insulation means located on a portion of the back-facing side of the water container. The crease may be formed by internally sealing the back-facing side of the water container to the opposite wall of the water container along a portion of its surface area.

The heat insulation means may comprise a horizontally disposed flexible waterproof heat insulating means which extends across a substantial portion of the back-facing side of the water container and may be intended to rest against the kidney area of a human being when the backpack is harnessed to the back of the human being. The water pump may be of a cylindrical construction with a nozzle at one end, and a water receiving hose at one end, (which can be the nozzle end), and is operated by pushing a rod and piston connected to a handle in the direction of the end carrying the nozzle. The water pump may include a protective covering and one or more disk or flapper-valves in its interior. The filler cap used to fill the backpack can include a screen for filtering solid debris from water poured into the interior of the water container.

DRAWINGS

In drawings which illustrate a preferred embodiment of the water, backpack and pump:

DETAILED DESCRIPTION OF ONE EMBODIMENT OF THE INVENTION

Figure 1:
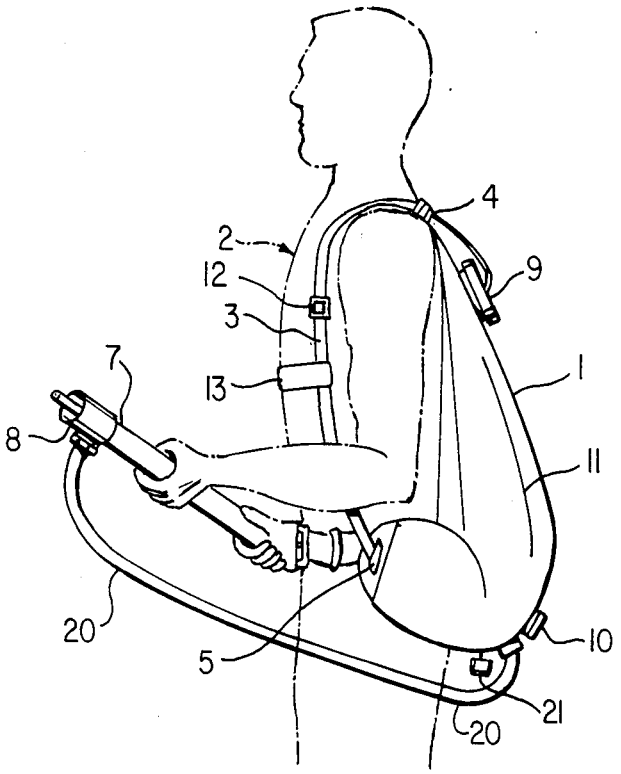
FIG. 1 illustrates a side perspective view of a firefighter carrying the water backpack and water pump.

Referring to FIG. 1, the water backpack 1 rests on the back of a firefighter 2 and is held in place by a shoulder harness 3 which attaches at each end to the top 4 and base 5 of the backpack 1 by means of welded or glued grommets or other suitable fastening means. A water pump 7 with nozzle 8 is held in the two hands of the firefighter 2. The water pump 7 is connected by means of a hose 20 to the base of the centre of the backpack 1. Centering the hose 20 ensures that the backpack 1 can be used equally well by both left and right handed operations. Also, centering the hose 20 permits maximum emptying of the water load inside the back pack 1 because as the back pack 1 is emptied, water flows to the bottom centre of the back pack 1.

FIG. 1 also illustrates the filling port and cap 9 which permits the backpack 1 to be filled with water and the drainage spout 10 which can be used to empty the backpack 1 if required. One of the two creases 11 in the rear side of the backpack 1 can also be seen in FIG. 1. A supplementary plug 21 is attached to the back pack 1 and can be used to plug the hose discharge outlet of the back pack 1 when the hose 20 is disconnected.

Figure 2:
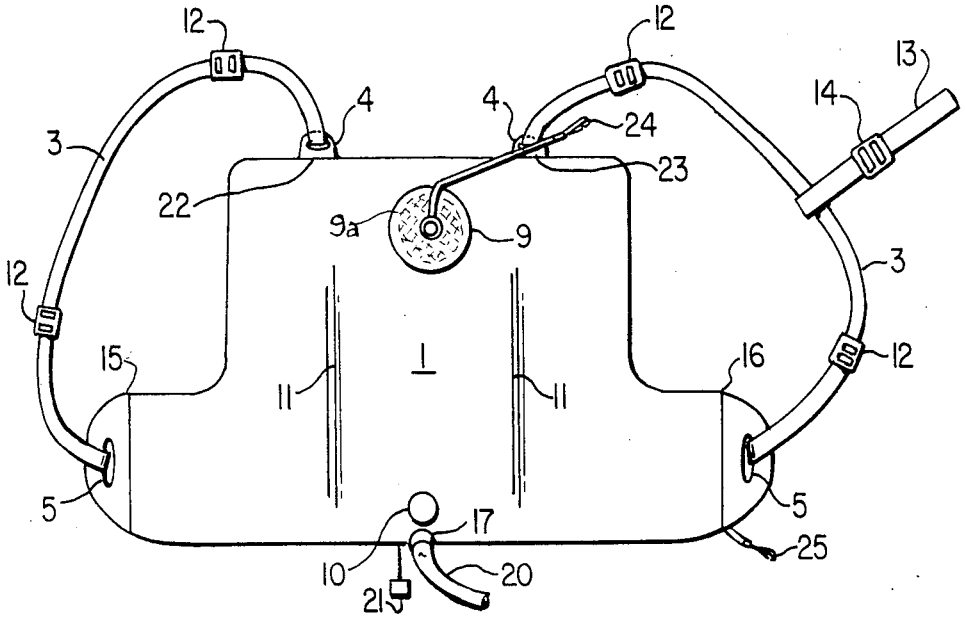
FIG. 2 illustrates a rear view of the water backpack and harness.

FIG. 2 illustrates the rear face of the backpack 1. As can be seen, the harness 3 comprises two vertical straps which attach at each end to respective fastening points 4 at the top and fastening point 5 at the bottom of the back pack 1. The location of the filler cap 9 and drainage spout 10 is also shown. The backpack 1 has two vertical creases 11 which extend upwardly in parallel orientation along a portion of the height of the backpack 1. These creases 11 represent linear indentations and can be formed by internally adhering the backside to the front side of the backpack 1 by means of electrical or heat welds or suitable adhesive. The harness 3 is adjustable to fit various sizes of firefighter by means of adjusting clips 12. The two vertical straps of the harness 3 are held at a fixed distance from one another by means of a rib strap 13 with adjusting clip 14. To prevent water leakage around the grommets at attachment points 4 and 5, electronic or heat welds are formed at locations 15, 16 22 and 23 by internally securing the front and rear faces together. Alternately, a suitable adhesive can be used to secure the front and rear faces together at locations 15, 16, 22 and 23. The outlet 17 for fastening to a hose 20 leading to the water pump 7 is located at the base of the back pack 1. A plug 21 for plugging outlet 17 when hose 20 is removed is attached at the bottom of the back pack 1.

Figure 3:
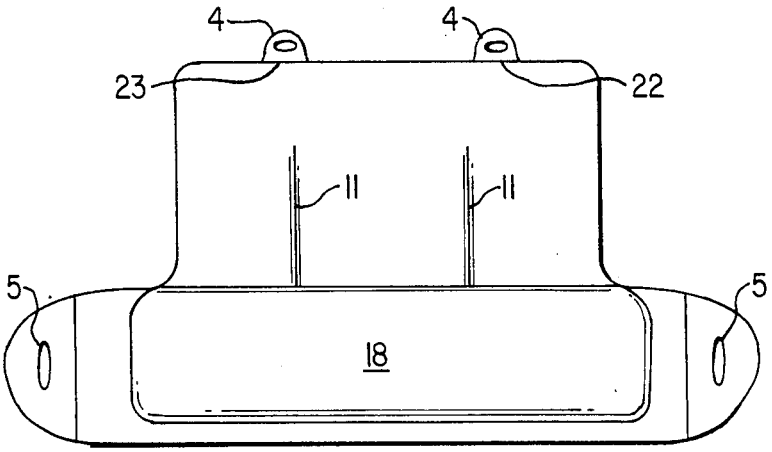
FIG. 3 illustrates a front view of the water backpack and the kidney insulating pad.

FIG. 3 illustrates the front face of the backpack 1, that is, the face which rests against the back of the firefighter. Two creases 11 which correspond with and are connected to the creases 11 shown on the rear face (FIG. 2) are visible. These creases 11 on the front face of the back pack 1 which are indentations, are an extremely important feature of the back pack 1 because they act as vents and permit perspiration to escape from the back of the firefighter 2 and also stabilize water shifting within the backpack 1. This ventilation feature enables the firefighter 2 to remain reasonably cool under the hot conditions usually associated with firefighting and reduces premature fatigue. FIG. 3 also illustrates the kidney insulating pad 18. This pad 18 extends across the base of the backpack 1 and is formed of a suitable, flexible, waterproof, insulating material such as a closed cell flexible polymer foam. Pad 18 is also an important feature of the backpack 1 because it prevents excessive heat loss from the lower back of the firefighter 2, and particularly from the kidney area of the firefighter 2 into the cold water in the backpack 1. This prevents back cramps and premature fatigue.

The applicant's back tank is tubular in design for maximum ventilation. The design is based on the findings of the Australian "Aquarius Project", which conducted tests on firefighters under fire fighting conditions and found the prime cause of fatigue among forest firefighters to be lack of cooling body ventilation.

The back tank 1 is typically constructed of a tough nylon exterior, all welded construction. It is typically of five U.S. gallon capacity. The backpack 1, when empty of water, is of light weight and is highly compactible. The empty weight of the tank (complete with pump) is typically 3½ pounds. Clogging is virtually eliminated by the applicant's flapper-valve designed pump (which will be discussed more fully below).

The backpack 1 has the following characteristics when in use. As water is consumed from the interior of the backpack 1, by reason of its inverted "T" construction, the bag tends to fold across the point where the inverted stem of the "T" joins the top bar of the "T", thereby providing a horizontal ventilation crease in addition to the two vertical creases 11. Further advantages of the backpack 1 are that the base of the filler cap 9 is welded or glued by means of electronic or heat weld or suitable adhesive directly to the backpack 1. This construction is durable and prevents leaks. Also, inside the filler cap 9, there is a mesh strainer **9*a* which is directly radio frequency welded to the fabric of the backpack 1. This strainer 9*a* conveniently strains out debris which might be present in the water used to fill the backpack 1**.

At the top and base of the backpack 1, there are also located snaps 24 and 25 into which the hand pump 7 can be clipped when it is not in use. This leaves both hands of the firefighter free to help maintain balance, and to use for grasping stationary objects when walking through heavy bush, or climbing over difficult terrain.

Another feature of the inverted "T" shape of the backpack 1 is that by concentrating a major amount of the water at a lower level, the centre of gravity of the backpack is lowered. This lower centre of gravity is advantageous because it generally corresponds with the centre of gravity of the firefighter 2 and therefore does not significantly raise or lower the centre of gravity of the firefighter. A difficulty with conventional backpacks for carrying water is that they tend to concentrate the bulk of the water on the shoulders of the firefighter 2. This raises the overall centre of gravity and tends to make the firefighter "top heavy". He is thereby prone to being tossed about whenever he makes abrupt movements.

Figure 4:
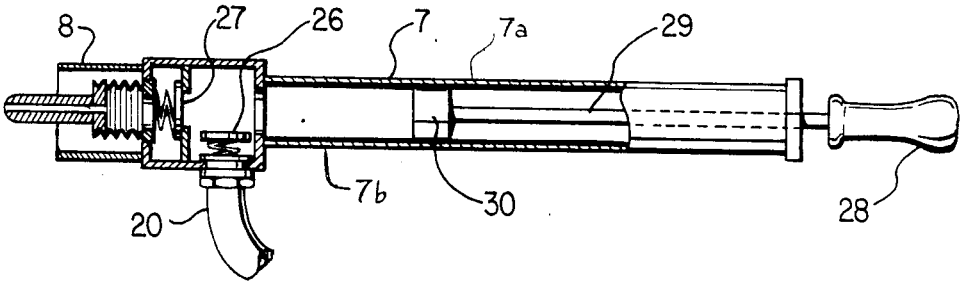
FIG. 4, which is shown on the same sheet as FIG. 1, illustrates a side, partially sectioned view of the water pump.

The water pump 7, as illustrated in FIG. 4, is also of unique construction and operation. The water pump 7 includes a free suspended disk valve-spring system 26 and 27 which permits water which has a relatively high debris content to pass through the water pump 7 without difficulty. Conventional water pumps usually have a ball valve check system which plugs up easily when there is any debris such as sand, dirt, and the like, present in the water.

Another advantage of the water pump 7 is that it is operated by pushing the pump handle 28 with rod 29 and piston 30 from the rear, rather than pulling the pump from the front, in order to obtain a pumping action. This rear pushing action enables the sprayed water from the pump to remain on target. It has been found that when pumps are compressed by pulling the pump from the front, the water pump tends to jerk sideways or up or down and thus a portion of the sprayed water misses the target and serves no purpose in quenching the fire. This action also provides an improved mechanical advantage and thus results in reduced operator fatigue.

The water pump typically is constructed to have a three quarter inch diameter discharge outlet, which is the same size as the common garden hose. The hose 20 is typically a five-eighths inch suction hose. Thus, typical garden hose accessories, including washers, can be used for servicing the water pump 7. No special "off-size" fittings are required. The water pump is constructed of a brass lined cylinder *7b*, which is covered with a high-impact plastic exterior *7a* which eliminates or greatly reduces exterior damage such as dents and creases which can occur to the cylinder when the water pump 7 is dropped or is banged against solid objects such as trees or rocks.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A water carrying backback and water pump combination useful in fighting fires comprising:

(a) a flexible collapsible hollow waterproof water container;

(b) harness means attached to the flexible water container suitable for securing the water container to the back of a human being;

(c) means for filling the water container;

(d) hand operated water pumping means;

(e) means for connecting the hand operated water pumping means with the water container in order to permit water from the interior of the water container to be delivered to the hand operated water pump; and (f) perspiration ventilation means located on the side of the water container which rests against the back of the human being, said ventilation means being an indentation formed by internally sealing the back-facing side of the water container to the opposite wall of the water container along a portion of its surface area.

2. An apparatus as defined in claim 1 wherein the water container includes heat insulation means located externally on a portion of the back-facing side of the water container.

3. An apparatus as defined in claim 2 wherein the heat insulation means comprises a horizontally disposed flexible waterproof heat insulating means which extends across a substantial portion of the back-facing side of the water container and rests against and protects against heat loss from the kidney area of a human being when the backpack is harnessed to the back of a human being.

4. An apparatus as defined in claim 1 wherein two parallel vertically extending indentation are formed in the water container.

5. An apparatus as defined in claim 1 wherein the water container is constructed generally to have the shape of an inverted "T", both the arms and stem of the "T" being capable of holding water.

6. An apparatus as defined in claim 1 wherein the water pumping means is of a cylindrical construction with a nozzle and a water receiving hose at one end, is operated by pushing a rod and piston connected to a handle in the direction of the end carrying the nozzle, and the water pumping means includes a pair of disk-spring valves, oppositely oriented to one another.

7. An apparatus as defined in claim 6 wherein the cylindrical water pumping means has a body which is constructed of a tubular non-corrodible liner and an exterior impact resistance jacket.

8. An apparatus as defined in claim 1 wherein the water container filling means includes a screen for filtering solid debris from water poured into the interior of the water container.

* * * * *